US011339485B1

(12) United States Patent
Root et al.

(10) Patent No.: US 11,339,485 B1
(45) Date of Patent: May 24, 2022

(54) ELECTROLYSIS ELECTRODE STRUCTURE

(71) Applicants: Jeffrey M Root, Palm Desert, CA (US); Clayton McMonigle Jones, Palm Springs, CA (US)

(72) Inventors: Jeffrey M Root, Palm Desert, CA (US); Clayton McMonigle Jones, Palm Springs, CA (US)

(73) Assignee: RQT Energy Storage Corp., Palm Desert, CA (US)

( * ) Notice: Subject to any disclaimer, the term of this patent is extended or adjusted under 35 U.S.C. 154(b) by 0 days.

(21) Appl. No.: 17/364,818

(22) Filed: Jun. 30, 2021

(51) Int. Cl.

| | |
|---|---|
| ***C25B 11/037*** | (2021.01) |
| ***C25B 9/01*** | (2021.01) |
| ***C25B 11/061*** | (2021.01) |
| ***C25B 11/054*** | (2021.01) |
| ***C25B 11/081*** | (2021.01) |
| ***C25B 9/65*** | (2021.01) |

(52) U.S. Cl.
CPC ..... *C25B 11/037* (2021.01); *C25B 9/01* (2021.01); *C25B 9/65* (2021.01); *C25B 11/054* (2021.01); *C25B 11/061* (2021.01); *C25B 11/081* (2021.01)

(58) Field of Classification Search
CPC ..... C25B 1/04; C25B 9/01; C25B 11/037; C25B 9/65; C25B 11/054; C25B 11/061; C25B 11/081
See application file for complete search history.

(56) References Cited

U.S. PATENT DOCUMENTS

| | | | | |
|---|---|---|---|---|
| 3,476,675 | A | 11/1969 | Colvin et al. | |
| 3,539,486 | A | 11/1970 | Fleck | |
| 3,645,880 | A | 2/1972 | Ueda | |
| 3,766,045 | A | 10/1973 | Itakura et al. | |
| 3,846,274 | A | 11/1974 | Gifford | |
| 4,399,009 | A * | 8/1983 | Chisholm | C08J 5/2281 205/521 |
| 4,444,632 | A * | 4/1984 | deNora | C25B 9/65 205/513 |
| 4,579,882 | A | 4/1986 | Kanbe et al. | |
| 5,240,569 | A | 8/1993 | Waldron | |
| 5,534,120 | A | 7/1996 | Ando et al. | |
| 5,865,966 | A | 2/1999 | Watanabe et al. | |
| 6,146,518 | A | 11/2000 | Fairlie et al. | |
| 6,290,894 | B1 | 9/2001 | Raj et al. | |

(Continued)

FOREIGN PATENT DOCUMENTS

JP 2019194349 A * 11/2019 ..... Y02E 60/36

*Primary Examiner* — Ciel P Contreras
(74) *Attorney, Agent, or Firm* — Kirk A. Buhler; Buhler & Associates Patenting

(57) ABSTRACT

Improvements in an electrolysis electrode structure where fluid or gas enters a chamber with cathode and anode charged conductors to polarize and separate the flow into two separate paths for electrolysis of the fluid or gas. The conductors wrap around magnets to extend the range of the polarizing field beyond the range of the electrode conductors. Iron particles fan-out from the conductors and magnets to further extend the polarizing field from the magnets as well as creating increased surface area for gas or liquids to flow within and around the conductors, magnet and iron particles. Noble metal provides a thin plating that locks the position of the particles and provides an open structure to allow for the flow of gas or fluids at a high rate of flow and prevents the iron particles from being eroded by the flow.

12 Claims, 3 Drawing Sheets

(56) References Cited

U.S. PATENT DOCUMENTS

| | | | | |
|---|---|---|---|---|
| 7,048,839 | B2 | 5/2006 | Harada | |
| 7,635,530 | B2 | 12/2009 | Kenis et al. | |
| 8,210,893 | B2 | 7/2012 | Jackson et al. | |
| 8,282,812 | B2 | 10/2012 | Burtch | |
| 8,308,919 | B2 | 11/2012 | Fletcher | |
| 8,940,151 | B1 | 1/2015 | Hartvigsen et al. | |
| 9,627,698 | B2 | 4/2017 | Wuillemin | |
| 9,656,885 | B2 | 5/2017 | Tappen | |
| 10,468,695 | B2 | 11/2019 | Wuillemin | |
| 10,479,707 | B2 | 11/2019 | Tappen | |
| 2006/0108215 | A1* | 5/2006 | Tzedakis | C12P 7/56 204/252 |
| 2007/0080101 | A1 | 4/2007 | Huang | |
| 2009/0224545 | A1* | 9/2009 | Davidson | F22B 1/021 290/52 |
| 2010/0108498 | A1* | 5/2010 | Griffin | C25B 9/40 204/278 |
| 2010/0181204 | A1* | 7/2010 | Griffin | C25B 5/00 205/339 |
| 2011/0100328 | A1 | 5/2011 | Paul | |
| 2011/0129758 | A1 | 6/2011 | Naya et al. | |
| 2012/0037512 | A1 | 2/2012 | Robertson | |
| 2012/0199472 | A1 | 8/2012 | Curfew | |
| 2012/0217155 | A1* | 8/2012 | Woodward | B82Y 30/00 204/242 |
| 2012/0234265 | A1 | 9/2012 | Ball | |
| 2014/0072836 | A1 | 3/2014 | Mills | |
| 2017/0314146 | A1* | 11/2017 | Hosseini Hashemi | C25B 1/04 |
| 2018/0057369 | A1 | 3/2018 | Lu et al. | |

* cited by examiner

ELECTROLYSIS ELECTRODE STRUCTURE

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in an electrode design. More particularly, the present electrolysis electrode structure creates improved electrodes using magnets and iron particles to increase the volume of gas per watt-hour that is generated.

Description of Related Art Including Information Disclosed Under 37 CFR 1.97 and 1.98

Most electrolysis units rely upon increasing the surface area of the electrodes that exist in the fluid flow stream. Simply increasing the surface area is only able to effect molecules in contact or in close proximity to the conductors. The use of magnetics to arrange or manipulate iron particles has been used in other applications and when using iron particles is fluid flow will often wash the iron particles with the flow. A number of patents and or publications have been made to address these issues. Exemplary examples of patents and or publications that try to address this/these problem(s) are identified and discussed below.

U.S. Pat. No. 8,282,812 issued on Oct. 9, 2012, to John Christopher Burtch and is titled Apparatus for Producing Hydrogen from Salt Water by Electrolysis. This patent discloses an apparatus for producing hydrogen from salt water by electrolysis. The apparatus includes an electrically connected cathode plate and an anode plate spaced apart from the cathode plate. The cathode plate is made from aluminum, and the anode plate is made from zinc. The aluminum cathode plate may have a multiplicity of apertures therein. While this patent discloses an electrolysis apparatus it does not use magnets.

U.S. Pat. No. 8,210,893 issued on Jul. 3, 2012, to Philip Jackson et al., and is titled Method and Apparatus for Control of a Flexible Material Using Magnetism. This patent discloses a flexible material infused with fine iron particles to form at least a portion of a flexible character or object. The flexible creation may be animated by one or more magnets or electromagnets brought near the flexible creation such that the iron particles blended with the flexible material may interact with the magnetic fields generated by the magnets. The infused iron particles may be attracted to the magnets, causing the object or portions of the object to move toward or away from the controlling magnets, thereby animating the object or portions of the object. The object may be constructed of a flexible iron-infused material that is introduced into the magnetic field while the material is in a liquid or semi-liquid state. While this patent discloses the use of iron particles with magnets it does not create a field for electrolysis.

U.S. Pat. No. 8,940,151 issued on Jan. 27, 2015, to Jeremy L. Hartvigsen et al., and is titled Water Electrolysis System and Method. This patent discloses a membrane-less electrolysis systems including an electrolysis chamber having an inlet for water, a cathode associated with the electrolysis chamber that includes a plurality of apertures within the cathode that fluidly couple the chamber with a cathode fluid pathway that is fluidly coupled to a hydrogen gas collector, that is fluidly coupled to an oxygen gas collector, a power source electrically coupled to the cathode and anode, and a pump fluidly coupled with the water reservoir and electrolysis chamber so that water is pumped into the electrolysis chamber, through the cathode and anode apertures, into the cathode and anode fluid pathways, and into the product gas collectors. This patent does not use magnets or iron particles.

U.S. Pat. No. 4,579,882 issued on Apr. 1, 1986, to Tokuzo Kanbe et al., and is titled Shielding Material of Electromagnetic Waves. This patent discloses a shielding material of electromagnetic waves of the invention is formed of a polymeric material as the matrix and an inorganic powder, e.g., mica flakes, metallized on the surface of the particles with a metal, e.g., nickel, as the conductive dispersant in the matrix. The metallization of the inorganic powder is performed by chemical plating, preferably, after pretreatment with an organic compound having a functional group capable of capturing ions of a noble metal and then with a solution containing a noble metal, preferably, palladium. This patent discloses a noble metal plating but there is no disclosure for electrolysis or magnets.

What is needed is electrodes that are used in electrolysis where the electrodes are formed around magnets and the magnets have attracted iron particles that bond the iron particles with noble metal(s).

BRIEF SUMMARY OF THE INVENTION

It is an object of the electrolysis electrode structure where fluid or gas enters a chamber with cathode and anode charged conductors to polarize and separate the flow into two separate paths for electrolysis of the fluid or gas. The catalytic structure can be extended to uses beyond electrolysis. Many reactions use noble metal catalysts, and recovery of the expensive metals from the reaction solution is difficult; filtration is slow and the particles fine. The active surface area of the catalyst is very large because of the open structure, without any need to dissolve an amalgam or any other processing.

It is an object of the electrolysis electrode structure to use magnets suspended within or around the conductors. The magnets can take a variety of shapes from cylindrical, bar, torus, ring or other shapes. The magnets extend the range of the polarizing field beyond the range of the electrode conductors. The conductors can be a single wire that is wrapped around the magnet or multiple conductors wrapped around the magnet. The catalytic effect of the magnetic field, if any, is different from the use of the field to form the pattern of particles, which in turn is different from the catalytic behavior of the noble metal plated onto the particles.

It is an object of the electrolysis electrode structure to use iron particles that fan-out from the conductors and magnets to further extend the polarizing field from the magnets as well as creates increased surface area for gas or liquids to flow within and around the conductors, magnet and iron particles. The particles can be put onto the magnet in air or in solution, but at some point, the structure has to be put into plating solutions.

It is still another object of the electrolysis electrode structure for the iron particles to be bonded in position using noble metals. The noble metal provides a thin plating that locks the position of the particles and provides an open structure to allow for the flow of gas or fluids at a high rate of flow and prevents the iron particles from being eroded by the flow.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
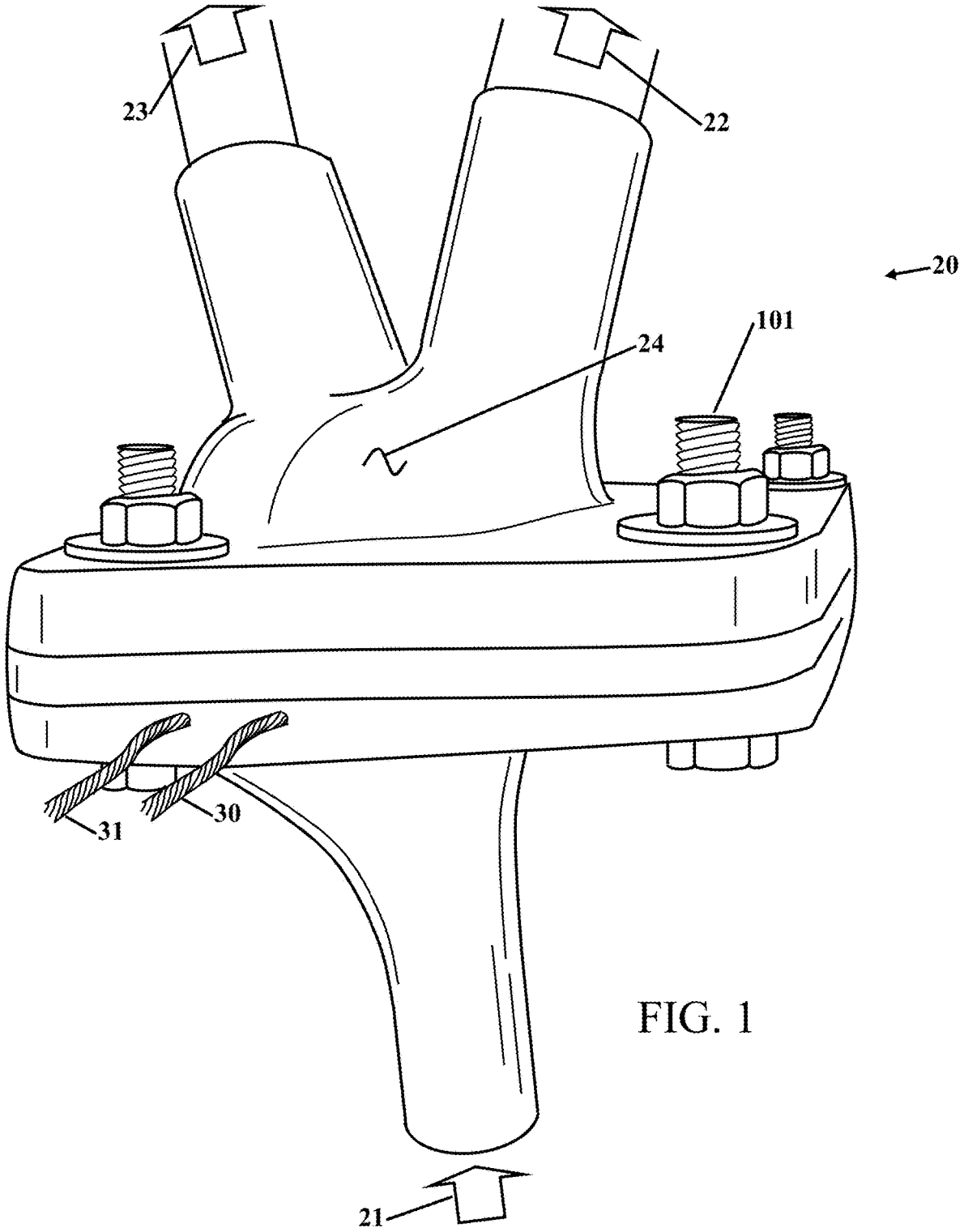
FIG. 1 shows a perspective view of a hyperbolic bifurcation device.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise.

It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof. It will be understood that like or analogous elements and/or components, referred to herein, may be identified throughout the drawings with like reference characters.

ITEM NUMBERS AND DESCRIPTION

20 hyperbolic bifurcation device
21 in flow
22 positive flow
23 negative flow
24 flow chamber
30 positive conductor
31 negative conductor
32 wire
33 wire wrap
40 cylindrical magnet
41 ring magnet
50 iron particles
101 fastener FIG. 1 shows a perspective view of a hyperbolic bifurcation device 20. The hyperbolic bifurcation device 20 is formed from housing two halves that are connected together with fasteners 101 and a seal that prevents leakage. At one side is an inflow 21 where fluid or gas enters the hyperbolic bifurcation device 20. The flow chamber 24 divides the flow past a positive conductor 22 or cathode and a negative conductor 31 or anode. This creates a positively charged flow 22 out one conductor and a negatively charged flow 23 out of the discharge tubes or ports. The conductors 30 and 31 are shown as twisted conductors extending out of the hyperbolic bifurcation device 20.

Figure 2:
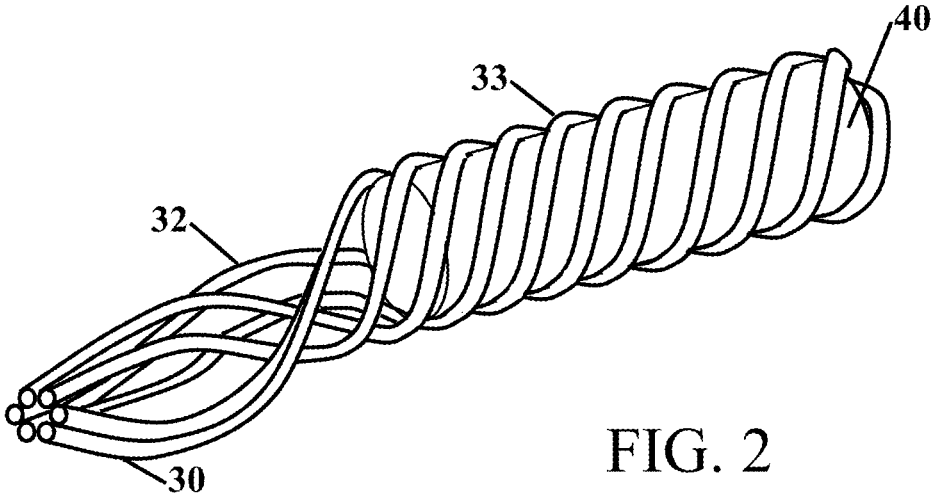
FIG. 2 shows a conductor wrapped around a bar or cylindrical magnet.
Figure 3:
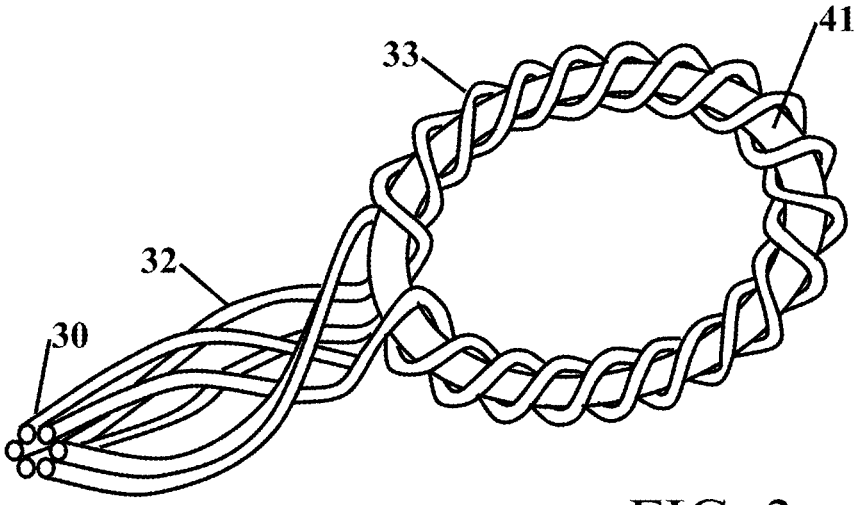
FIG. 3 shows a conductor wrapped around a torus or ring magnet.

FIG. 2 shows a conductor wrapped around a bar or cylindrical magnet 40 and FIG. 3 shows a conductor wrapped or restrained around a torus or ring magnet 41. The magnets are preferably neodymium (N52) magnets, but other magnet types are contemplated. While the collective bundle of wire(s) 32 is shown as the positive conductor 30 it could equally be the negative conductor. In FIG. 2 the conductors are spread with a wire wrap 33 around the cylindrical magnet 33 the wire wrap 33 is shown with gaps between the conductors but could also be wrapped around the magnet as adjacent (touching) conductors. The wire wrap 33 individual wire(s) 32 are collected to the positive (or negative) conductor 30. This figure shows the positive conductor 30 extending away from one side of the cylindrical magnet 40 but could also be wrapped and extend from both sides of the cylindrical magnet 40.

In FIG. 3, the wire wrap 33 is looped through and around the ring magnet 41. And the individual wire(s) 32 are collected to the positive (or negative) conductor 30. The ring magnet 41 can be configured with a positive side and a negative side and the orientation and the orientation can be used when the magnet is placed within the hyperbolic bifurcation device based upon the direction of flow through the hyperbolic bifurcation device. The conductors are preferable made of nickel or iron, but conductors made from other materials are contemplated such as, but not limited to cobalt, other metals or various alloys can be used as long as they are attracted to a magnet. Since the conductors are wrapped around the magnets there is no need for mechanical fastening of the magnet to a ferromagnetic conductor such as nickel or iron. The magnets 41 (or 40) are integrated into the electrode by twisting pure nickel wire 32 around the magnet 41 (or 40) to increase the volume of gas per watt. The magnetic attraction is sufficient to prevent movement of the magnets with flow through the hyperbolic bifurcation device. The magnetic field is created emanating from a suitable substrate object.

Figure 4:
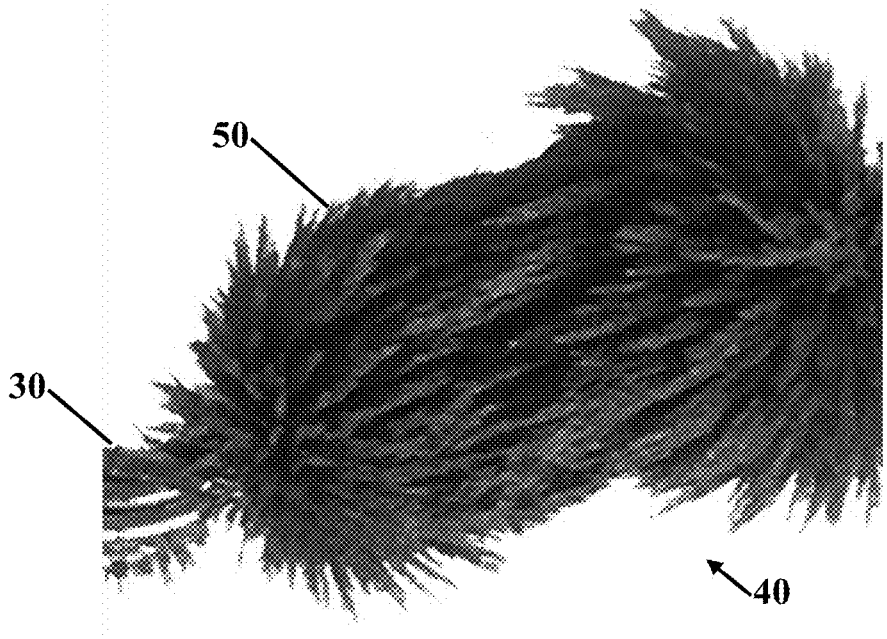
FIG. 4 shows a conductor wrapped around a bar or cylindrical magnet with iron particles.

FIG. 4 shows a conductor wrapped around a bar or cylindrical magnet 40 with iron particles 50. A plurality of magnetically susceptible particles is arranged around the object to form an open structure along the magnetic field lines. The plurality of iron particles is attracted to the magnet and leave an open structure for flow of fluid or gas through the hyperbolic bifurcation device. The active surface area of the catalyst is very large because of the open structure, without any need to dissolve an amalgam or any other processing. In older designs the iron particles can be difficult to retain inside the electrode, as the formation of hydrogen bubbles transported the particles out. At high flow rates, the flow can "carry" the iron particles with the flow. Common practice was to blend a "soup" of iron, carbon and various methyl cellulose binders. The magnetic attraction of the electrolysis electrode structure is sufficient to prevent movement of the iron particles with flow through the hyperbolic bifurcation device. It is also contemplated to start with the magnetic material in a powder form and cast or mold the magnetic material with plastic or resin into a shape and solidified.

Figure 5:
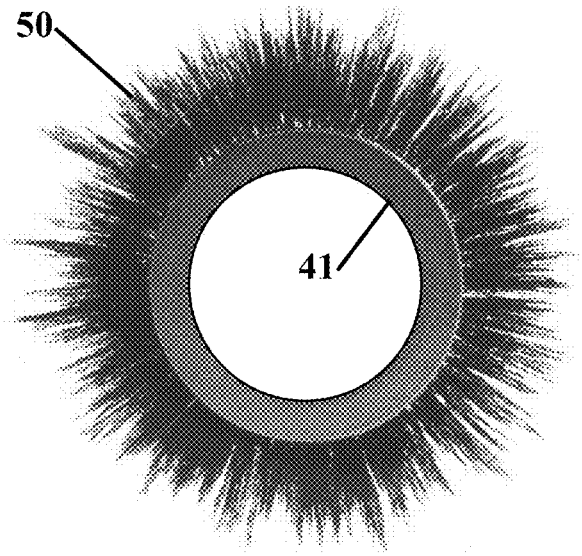
FIG. 5 shows a conductor wrapped around a torus or ring magnet with iron particles.

FIG. 5 shows a conductor wrapped around a torus or ring magnet with a plurality of iron particles 50. When the iron particles 50 are poured into the vicinity of the magnets 41 (or 40), either in air or in liquid, the particles adhere in a "starburst" pattern at the poles and "bridging" pattern between poles. To prevent the iron particles 50 from being carried with the flow, the iron particles 50 are electroplated with platinum or palladium. The iron particles are "electroless" plated with a noble metal such as platinum or palladium after securing the magnet in the conductor and after formation of the starburst shape of the iron particles 50. This creates a stable structure of the iron particles 50 that is resistive to the current flows and to bubble convection, and that electroless plating occurs uniformly. The palladium will penetrate to the surface of the iron particles 50 in a uniform fashion. While the preferred plating metal is palladium, other metals are contemplated including, but not limited to, gold (Au), silver (Ag), platinum (Pt), or palladium (Pd) but can also be Rhenium (Re), osmium (Os), iridium (Ir), Mercury (Hg), Molybdenum (Mo), ruthenium (Ru), rhenium (Rh), Cadmium (Cd), and sometimes Vanadium (V), Chromium (Cr), Titanium (Ti), Aluminum (Al), Niobium (Nb), Tantalum (Ta) as catalysts.

The noble metal is reduced to adhere to the surface of the catalytic structure. The assembly is rinsed in a suitable fashion and as may or may not be necessary an in-situ construction a cleansing solution would be passed over the catalyst prior to reactants.

The iron particles will be attracted to the magnet to form the iron particle matrix. After forming the iron particle matrix, the iron particle matrix can be electroless plated with a noble metal. The noble metal plating may require pretreatment steps on the magnetic particle, prior to immersion in a solution of noble metal. A suitable reducer can be added to the solution held at a suitable temperature and pH. A typical reducer is hypophosphite, which can leave phosphate in the plate. Other contemplated reducers are lithium aluminum hydride, sodium borohydride or hydrazine.

The palladium plate can be extremely thin, even incomplete, so the cost per electrode is small because the iron or nickel conductor also operate as a catalyst. The geometry of the electrode is very versatile and can be utilized with bipolar electrodes. Many reactions are catalyzed by the noble metal plating. It is not necessary that the magnets are incorporated physically into the conductor and could be placed around the electrode in any number of geometries, some of which may enhance the catalysis. A continuous flow-through reaction chamber is also contemplated by placing the magnets outside of the hyperbolic bifurcation device tube and pouring ferromagnetic particles inside the tube(s). The catalytic effect of the magnetic field may be used on the field to form the pattern of the iron particles, which in turn is different from the catalytic behavior of the noble metal plated onto the particles.

When the magnet is external from the housing the magnet is placed in proximity to at least one of the cathode conductor or the anode conductor so some of the magnetic field envelopes at least one of the cathode conductor or the anode conductor. The magnetically susceptible particles that are magnetically attracted to the magnet within the housing and within at least a portion of the magnet field that envelopes the cathode conductor and/or the anode conductor. The magnetically susceptible particles are then plated with a noble metal to create a stable structure of magnetically susceptible particles within the housing and within at least a portion of the magnet field that envelopes at a portion of the cathode conductor and/or the anode conductor.

It is further contemplated that the magnet could be used as a magnetic sheet, where magnetic powder is attracted and then plated with noble metal. A problem with hydrogen in alkaline generators is that gas bubbles form a persistent emulsion of tiny bubbles which come out of the solution slowly. While this is not an issue with static cells, it can be a problem if the electrolyte is pumped past the electrodes at a high rate, because the emulsion cannot be allowed to recirculate. In this embodiment, the magnetic particles can be formed in a rotating "scrub brush" of iron particles held to the container wall by magnets on the outside of the housing. While the magnetic field disclosed are physical magnets, it is also contemplated that the magnetic field could be created electromagnetically with suitable coils and current.

Thus, specific embodiments of an electrolysis electrode structure have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. An electrolysis electrode structure comprising:

a housing with a cathode conductor and an anode conductor that each extend into said housing;

at least one of said cathode conductor or said anode conductor having a magnet restrained within said at least one of said cathode conductor or said anode conductor;

said magnet having a plurality of magnetically susceptible particles that are magnetically attracted to said magnet, and said susceptible particles being plated with a metal selected from said a group consisting of gold (Au), silver (Ag), platinum (Pt), palladium (Pd), Rhenium (Re), osmium (Os), iridium (Ir), Mercury (Hg), Molybdenum (Mo), ruthenium (Ru), Cadmium (Cd), Vanadium (V), Chromium (Cr), Titanium (Ti), Aluminum (Al), Niobium (Nb) or Tantalum (Ta) to create a stable structure of magnetically susceptible particles that are directly bonded on said magnet and directly bonded on said at least one of said cathode conductor or said anode conductor.

2. The electrolysis electrode structure according to claim 1, wherein said housing is a hyperbolic bifurcation device.

3. The electrolysis electrode structure according to claim 1, wherein at least one of said cathode conductor or said anode conductor is a ferromagnetic conductor.

4. The electrolysis electrode structure according to claim 3, wherein said ferromagnetic conductor is selected from the group of cobalt or nickel.

5. The electrolysis electrode structure according to claim 1, wherein said magnet is a neodymium magnet.

6. The electrolysis electrode structure according to claim 1, wherein said magnet is a bar magnet, a rod magnet, a ring magnet or a torus magnet.

7. The electrolysis electrode structure according to claim 1, wherein said magnet is formed in a shape other than a bar magnet, a rod magnet, a ring magnet or a torus magnet.

8. The electrolysis electrode structure according to claim 1, wherein said magnetically susceptible particles is selected from the group of cobalt or nickel.

9. The electrolysis electrode structure according to claim 1, wherein said magnetically susceptible particles are something other than iron, nickel or cobalt.

10. The electrolysis electrode structure according to claim 1, further includes pre-treatment of a reducer prior to plating said metal.

11. The electrolysis electrode structure according to claim 10, wherein said reducer is hypophosphite, lithium aluminum hydride, sodium borohydride or hydrazine.

12. The electrolysis electrode structure according to claim 1, wherein said magnet is an electromagnet.

* * * * *